US006142844A

United States Patent [19]

Klauber

[11] Patent Number: 6,142,844

[45] Date of Patent: Nov. 7, 2000

[54] RAFT FOR A PERSON IN A FACE DOWN POSITION

[76] Inventor: Mark Klauber, 1964 Edge Rd., Muttontown, N.Y. 11791

[21] Appl. No.: 09/451,363

[22] Filed: Nov. 30, 1999

[51] Int. Cl.[7] ..... B63C 9/08

[52] U.S. Cl. ..... 441/129; 5/638

[58] Field of Search ..... 441/128, 129, 441/135, 136; 5/638, 733, 704

[56] References Cited

U.S. PATENT DOCUMENTS

| | | | |
|---|---|---|---|
| 2,712,139 | 7/1955 | Kelly . | |
| 2,717,399 | 9/1955 | Backhouse . | |
| 4,723,329 | 2/1988 | Vaccaro . | |
| 5,960,494 | 10/1999 | Guillilland et al. | 5/638 |

FOREIGN PATENT DOCUMENTS

| | | | |
|---|---|---|---|
| 458331 | 4/1951 | Italy | 441/135 |

*Primary Examiner*—Jesus D. Sotelo
*Attorney, Agent, or Firm*—Collard & Roe, PC

[57] ABSTRACT

The invention relates to a device for supporting a person lying down. The device comprises a vertical breathing hole designed to allow a person to lie face down and continue breathing. In a preferred embodiment where this device is a raft, there is additional provision for breathing so that there is a series of lateral breathing holes disposed above a waterline. In this way, when a person lies face down, that person places their face adjacent to these breathing holes, and draws air into their lungs. Thus, the person does not have to turn their head to the side to breathe.

8 Claims, 2 Drawing Sheets

RAFT FOR A PERSON IN A FACE DOWN POSITION

BACKGROUND OF THE INVENTION

1. Field of the Invention

The invention relates to a flotation device or raft having a center headrest portion cut out so that a person can rest face down in the raft while still breathing comfortably. The center headrest portion of the raft has a series of downward extending projections to elevate the headrest above the water. In this case, the headrest portion can extend down only in certain regions so as to create holes or other gaps in adjacent regions to allow air to enter underneath the headrest. In this way, a person lying face down on the raft can still breathe.

2. Description of the Prior Art

U.S. Pat. No. 2,717,399 to Backhouse discloses an underwater viewing device for a raft wherein the center region is cut out. This allows a person to lie face down while viewing the water. In this case, there's a through-way 3 formed by a tube 4 of flexible rubberized material. There is also a transparent window 5 of glass or transparent plastic material located within this cut-out region. This device does not have flotation elements extending downward from the headrest to raise the headrest above the water, and it has an end hole designed to allow a person to breathe while resting face down on the mattress.

U.S. Pat. No. 2,712,139 to Kelly discloses an underwater viewing device that has a rigid plastic material for a window 24. In this case as well, there are no raised portions to allow a person to breathe while lying face down on the mattress.

U.S. Pat. No. 4,723,329 to Vaccaro discloses a mattress having a center cut out designed to allow a person to lie face down. This mattress does not have regions underneath the headrest for receiving air, rather it has a hole on the side of the mattress for receiving air into the face down head region.

The prior art shows a headrest for receiving a person's head lying face down on the mattress. However, this prior art does not show a headrest having flotation elements that extend down into the water for raising the headrest above the water. In addition, the prior art does not show air pockets disposed below the mattress and extending through the headrest for receiving air into the face down region so a person lying face down in the mattress can breathe.

SUMMARY OF THE INVENTION

One object of the invention is to provide a flotation device or raft that is simple in design and easy to manufacture.

Another object of the invention is to provide a raft that allows a person to breathe while lying face down.

Another object of the invention is to provide a raft that provides breathing holes on a side of the raft.

Another object of the invention is to provide a raft that allows a person to be in a comfortable and ergonomically relaxing position lying on their stomach or on their back.

These and other objects are solved by providing a support device or raft for a person lying in a face down position. The first embodiment is a one piece molded foam raft. The foam is soft, buoyant and flexible and is shaped to provide an ergonomic and relaxing posture. There is a vertical breathing hole designed to allow a person to lie face down and continue breathing.

The bottom section includes a series of alternating support projections and lateral breathing holes that are defined by the raft and the waterline when the raft is resting in the water. In this way, when a person lies face down, that person places their face in the vertical breathing hole, and draws air from these breathing holes through the vertical breathing hole and into their lungs. Thus, because of this design, the person does not have to turn his head to the side to breathe. This allows for a neutral and relaxing position for the spine and musculature of the shoulders, face and neck.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
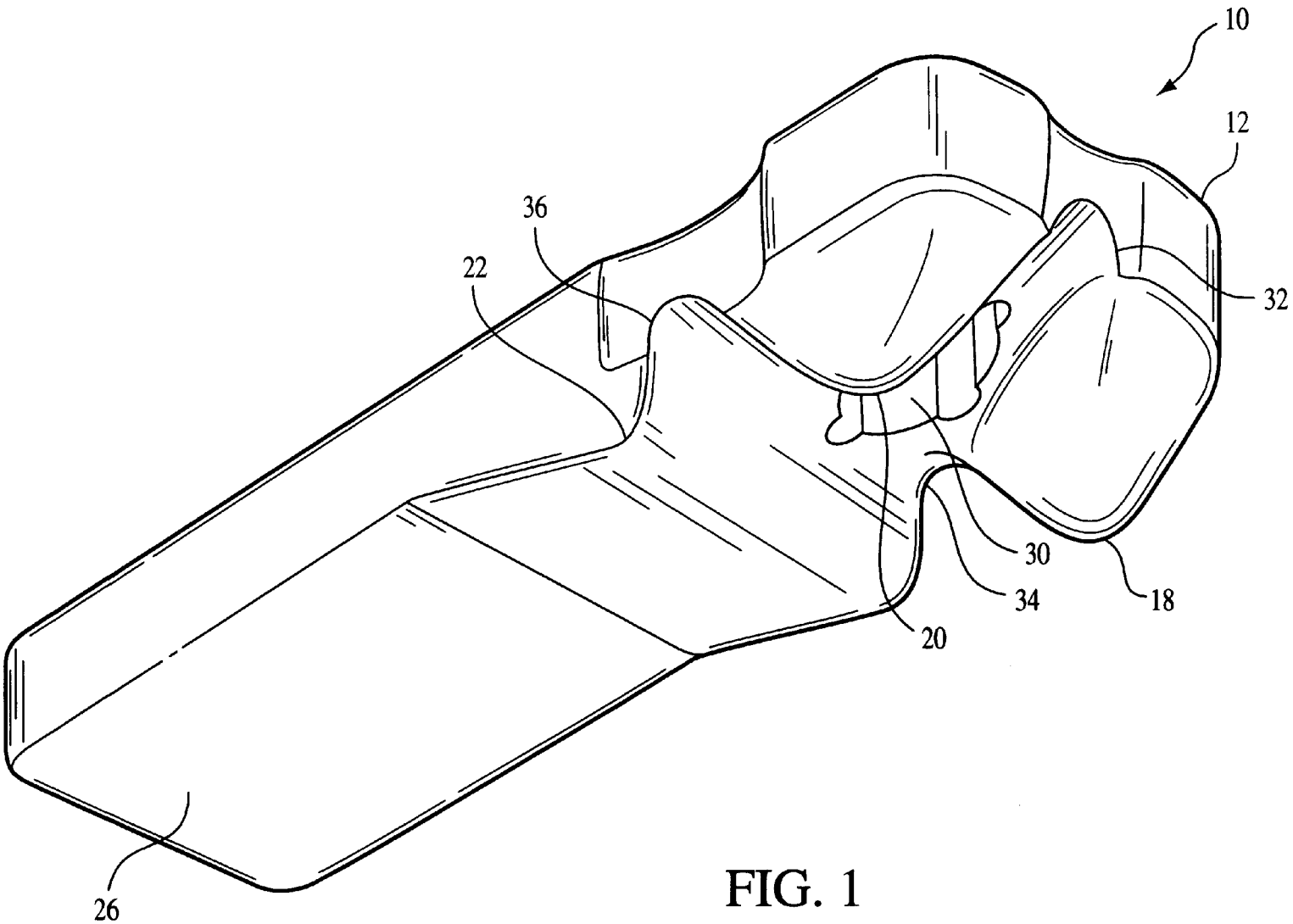
FIG. 1 is a perspective view of the raft.

FIG. 1 shows a perspective view of a support device or raft 10 for supporting a person above a surface such as a waterline. In a preferred embodiment, support device 10 is a one piece molded raft made entirely from soft, buoyant foam. The bottom has a surface 26 with spherical support projections 18 and 20 extending down from a middle region of surface 26. In this case, when a person lies face down on raft 10, they can breathe freely without having to turn their head to one side by having air pass through lateral breathing holes 32, 34, and 36.

Figure 2:
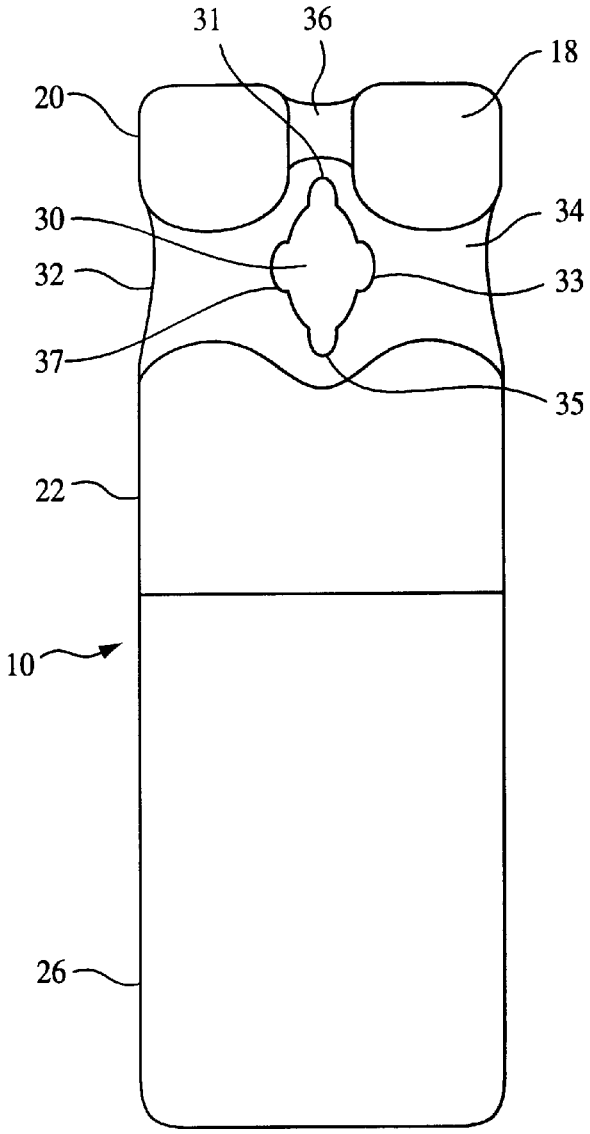
FIG. 2 is a bottom view of the raft.

FIG. 2 is a bottom view of raft 10 having a substantially rectangular shape. In this view, there are lateral breathing holes 32, 34, and 36. The center hole 30 is molded into raft 10 so that when a person lies face down on raft 10, (FIG. 3) they can breathe through center hole 30 without turning their head to one side. Center hole 30 has extended portions 31, 33, 35 and 37 that are designed to allow air to flow around a person's face when a person is lying face down on hole 30. In this way, air can both flow down into the raft and up through raft 10 while the person's face is placed within hole 30.

Figure 3:
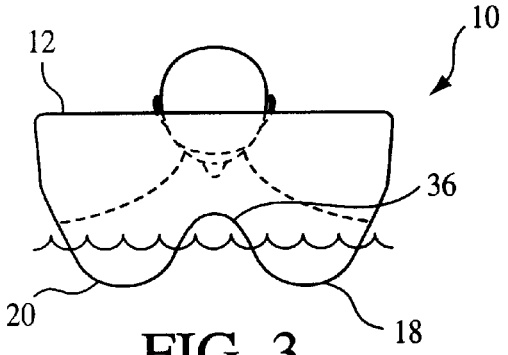
FIG. 3 is a front end view of the raft.

FIG. 3 shows a front end view of raft 10 wherein on the bottom there are shown semi-spherical projections 18 and 20 with breathing hole 36 shown in between. Raft 10 rests on top of the water so as to form holes 32, 34, and 36 for breathing when a person is lying face down on the raft.

Figure 4:
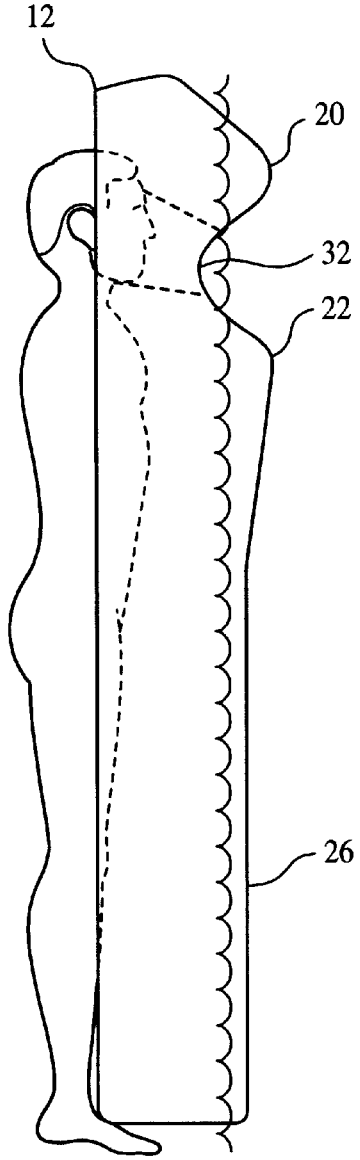
FIG. 4 is a side view of the raft.

FIG. 4 shows a side view of raft 10. In this view, semispherical protrusion 20 extends down past the water line, rises up to breathing hole 32, and back down to semi-spherical projection 22.

This design is important because it allows a person to lie face down on a raft while still allowing a person to breathe easily. In addition, the molded design of this feature is unlike other designs because bottom portion 16 has molded breathing holes 32, 34, and 36 that rise above the water level rather than sitting between two portions of a raft. This design feature is important because if the breathing hole was self contained between two pieces of a raft, then it becomes hard to clean the raft and it may lead to unsanitary conditions such as mold growth. This raft 10 is also particularly easy to manufacture as a one-piece molded foam flotation device.

In addition, this raft could be made hollow and be inflatable so that it could be inflated to float above water. In this way, this inflatable raft would float above water while still providing lateral breathing holes allowing a person to breathe while lying face down.

One of the most significant features of this raft is that it allows a person to lie face down or face up in an ergonomically advantageous position. For example, when a person is lying face down on the raft, they can place their face inside of vertical hole 30 while looking at the water. Thus, they do not have to turn their head to one side or another which could lead to pain or muscular tension. When a person flips over on their back, they could rest their head back on the headrest with the headrest tilting up to support a person's head.

Since a foam injection process allows for an almost infinite variety of shapes, there is a more refined embodiment that could be manufactured. At the base of the vertical hole (30), a channel could commence which could extend down towards the middle of the raft. This channel could allow for cradling and supporting the back or front of a person's neck, shoulders and chest whether a person is in a prone or supine position. The raft could also include a greater volume of buoyant foam around the end supporting the upper body and head. This could be engineered to keep the body essentially parallel to the water or to actually cant the raft upward to compensate for the fact that the head would be slightly lower when it is partially engulfed by the vertical hole (30).

Furthermore, this raft or support device could be used on a side of a pool or even outside of a pool area. In this case, any person who desires to lie face down without having to turn their head to one side, could use this raft or support device to support them in a face down position.

Accordingly, while two embodiments of the present invention have been shown and described, it is to be understood that many changes and modifications may be made thereunto without departing from the spirit and scope of the invention as defined in the appended claims.

What is claimed is:

1. An ergonomic support device formed as a one piece raft made from a polymer for allowing a person to lie in a prone or supine position comprising:

a) a top portion having a vertical breathing hole; and b) a bottom portion that forms a series of alternating support projections and lateral breathing holes wherein said lateral breathing holes are in communication with said vertical breathing hole so that when a person lies face down, said lateral breathing holes are supported above a support surface by said support projections so that a person can draw air from said lateral breathing holes up through said vertical breathing hole and into their lungs.

2. The device as claimed in claim 1, further comprising a series of semi-circular holes extending radially off from said vertical breathing hole so that when a person lies face down with their face in said vertical breathing hole, said semi-circular holes provide additional side air holes allowing air to travel down through the device to a person's mouth and up through the device past a person's face.

3. The device as claimed in claim 1, wherein said support projections comprise a first set of support projections that are shaped semi-spherical, and spaced apart from each other, and a second set of at least one support projection that are shaped semi-cylindrical wherein said first support projections are spaced apart from each other and apart from said second set of said at least one support projection.

4. The device as claimed in claim 1, wherein said vertical hole is substantially oval-shaped.

5. The device as claimed in claim 1, wherein said device is formed as hollow and can be inflatable.

6. The device as claimed in claim 1, wherein said device is injection molded.

7. The device as claimed in claim 1, wherein said top portion has a top surface of which is contoured to conform to a person's body, to reduce contact with pressure points to provide relaxing position for a user.

8. An ergonomic support device for allowing a person to lie in a prone or supine position comprising:

a) a top portion having a vertical breathing hole; and b) a bottom portion that forms a series of alternating support projections and lateral breathing holes wherein at least one of said support projections is shaped semi-spherical and said lateral breathing holes are in communication with said vertical breathing hole so that when a person lies face down, said lateral breathing holes are supported above a support surface by said support projections so that a person can draw air from said lateral breathing holes up through said vertical breathing hole and into their lungs.

* * * * *